US005547526A

United States Patent [19]

Wanninger et al.

[11] Patent Number: 5,547,526

[45] Date of Patent: Aug. 20, 1996

[54] PRESSABLE EXPLOSIVE GRANULAR PRODUCT AND PRESSED EXPLOSIVE CHARGE

[75] Inventors: Paul Wanninger, Schrobenhausen; Richard Wild, Karlshuld; Ernst Kleinschmidt; Helmut Späth, both of Schrobenhausen, all of Germany

[73] Assignee: Daimler-Benz Aerospace AG, München, Germany

[21] Appl. No.: 230,735

[22] Filed: Apr. 21, 1994

Related U.S. Application Data

[63] Continuation-in-part of Ser. No. 953,642, Sep. 29, 1992, abandoned, which is a continuation-in-part of Ser. No. 665,404, Mar. 5, 1991, Pat. No. 5,183,520.

[30] Foreign Application Priority Data

Mar. 6, 1990 [DE] Germany ..... 40 06 961.3

[51] Int. Cl.[6] ..... C06B 45/10

[52] U.S. Cl. ..... 149/19.2; 149/19.91; 149/19.92

[58] Field of Search ..... 149/19.91, 19.92, 149/19.1, 19.2

[56] References Cited

U.S. PATENT DOCUMENTS 2,999,744 9/1961 Eckels .
3,972,856 8/1976 Mitsch et al. .
4,047,090 9/1977 Falterman et al. .
4,050,968 9/1977 Goldhagen et al. .
4,088,518 5/1978 Kehren et al. .
4,090,894 5/1978 Reed et al. .
4,428,786 1/1984 Anri .
4,842,659 7/1989 Mezger et al. .
4,853,051 8/1989 Bennett et al. .
5,009,728 4/1991 Chan et al. .
5,183,520 2/1993 Wanninger et al. .

OTHER PUBLICATIONS

Wacker RTV–2 Siliconkautschuk Brochure F. R. Wacker Silicone.

*Primary Examiner*—Charles T. Jordan
*Assistant Examiner*—J. R. Hardee
*Attorney, Agent, or Firm*—McGlew and Tuttle, P.C.

[57] ABSTRACT

A pressed explosive charge with high performance capacity and low sensitivity is formed of a pressable granular product. The pressable granular product has a high explosive content, preferably above 94% by weight and even more preferably above 96% by weight. The binder is a gel-like silicon rubber.

25 Claims, 1 Drawing Sheet

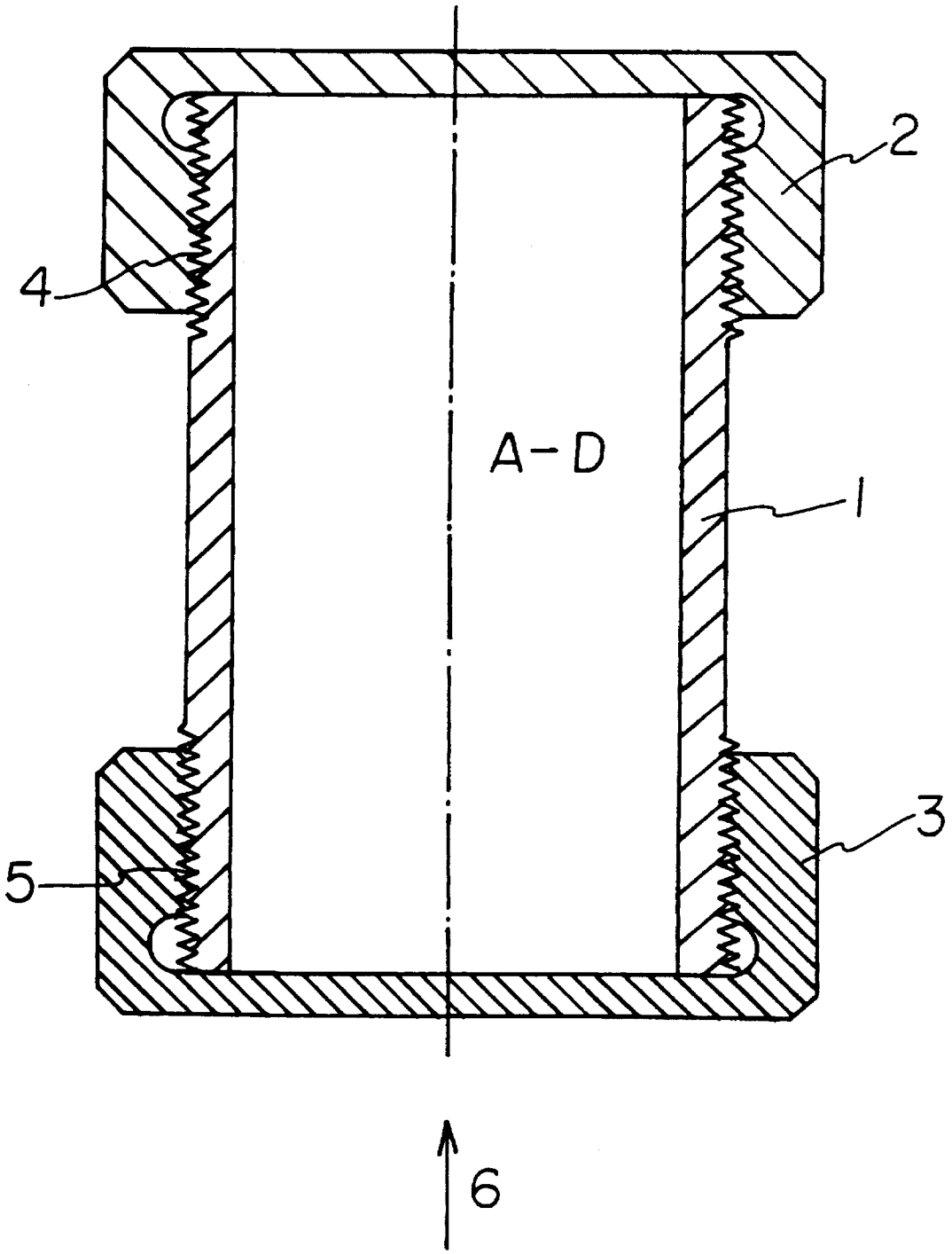
2
4
A-D
1
3
5
6

PRESSABLE EXPLOSIVE GRANULAR PRODUCT AND PRESSED EXPLOSIVE CHARGE

This is a continuation-in-part of application Ser. No. 07/953,642 filed Sep. 29, 1992, now abandoned, which is a continuation-in-part of application Ser. No. 07/665,404, filed Mar. 5, 1991 which has matured into U.S. Pat. No. 5,183,520.

FIELD OF THE INVENTION

The present invention pertains to a pressed, plastic-bonded explosive charge. It also pertains to an explosive/plastic binder granular product for producing such an explosive charge.

BACKGROUND OF THE INVENTION

The pressing of explosive charges by means of hydraulic presses under high pressures of up to 1000 bar and higher represents the most important process for shaping high-explosive explosive charges, besides casting. However, while plastic-bonded explosive charges produced by casting contain only at most 90 wt. % explosive, a higher percentage of explosive, equaling 95 wt. % or higher, can be reached in the case of pressed plastic-bonded explosive charges.

In plastic-bonded explosive charges, thermoplastics or curable plastics, in which the crystalline explosive particles are embedded, are used as the binder for the crystalline explosive. The charge molding is then produced from the granular explosive and plastic by pressing.

Due to the above-mentioned high percentage of explosive and the use of high explosives, such as Octogen, pressed, plastic-bonded explosive charges have a high energy content. Therefore, they are used mainly for hollow charges and similar shaped charges.

The commercially available explosive/plastic binder granular products for producing pressed charges contain especially polyurethanes as well as fluoropolymers as the plastic binder. Thus, a granular product containing a hexafluoropropylene-vinylidene fluoride polymer known under the trademark "VITON A" and another granular product with a thermoplastic polyurethane binder under the trademark "ESTANE" as the plastic binder are commercially available.

However, at high percentages of Octogen of 95 wt. % or more, the pressed explosive charges produced from these granular products are extremely sensitive and therefore do not meet the requirements imposed in terms of the safety of ammunition, e.g., against bullet impact and fire.

U.S. Pat. No. 4,050,968 discloses an explosive composition comprising an explosive such as RDX (Hexogen), HMX (Octogen), or perchlorate salts. This patent proposes an explosive content from about 50% to 95% at column 2, line 17. However, the binder content is more than 5% of the composition. In practice the binder content is much higher, namely about 18% according to the typical compositions set forth in column 5, line 63 to column 6, line 5. In this example, the castable explosive composition has an HMX-content of 80.5% or less (see table at bridging columns 5 and 6). The binder is an acrylate copolymer containing a plasticizer.

U.S. Pat. No. 4,050,968 is clearly directed to castable charges (see inter alia column 1, line 8) and such castable charges cannot have a high charge density (i.e. 97% of the theoretical maximum density). The maximum density of a cast charge, with a solids content of more than 90%, especially more than 94%, is in fact below 92%. This physical limit relates to the fact that the maximum density obtained by casting is achieved with the so-called most dense cubic or hexagonal sphere packing. In such sphere packing voids between the grains are unavoidable. This presents a physical barrier as to density. Further, for casting, the composition must freely flow. To gain a freely flowing composition, the binder must be able to form a liquid film between the grains of the explosive. Accordingly with the castable compositions as proposed by U.S. Pat. No. 4,050,968, a high binder content is necessary. U.S. Pat. No. 4,050,968 is silent about the density of the charge compared with the theoretical maximum density.

U.S. Pat. No. 4,428,786 concerns a mixture with 90 to 97% by weight of a powerful explosive compound, such as octogen, and 3 to 10% by weight of a stabilizing agent. Tetrafluoroethylene mentioned in column 1, lines 65, 66 has a high shore hardness, so that an explosive charge containing this binder will be extremely sensitive. The drop hammer test and the friction peg test stated in column 6, line 63 to column 7, line 10 are standard tests which explosives have to fulfill for obtaining transportation permission at all. That is, these are very rough tests and are not comparable with the much more sophisticated tests as the Cookoff test and the other sensitivity tests described in the report of the Naval Surface Warfare Center in Dahlgren, Va., mentioned below.

U.S. Pat. No. 4,842,659 discloses an explosive composition containing nitropropyl (NP) compounds and cellulose acetate butyrate (CAB) as binder, that is a composition which is similar to DAX-2 and PAX-2A according to table 1 of the report of the Naval Surface Warfare Center, mentioned below. As can be seen from this report, PAX-2 failed the Slow Cookoff test, because of explosion (table 5) and showed a considerably lower armor penetration at stand-offs of 2, 5 and 7 CDs as the charge of the present invention, that is PBXP-31.

U.S. Pat. No. 2,999,744 uses a polysiloxane as shown in column 3, lines 3 to 6 and 25 to 30. This is a polysiloxane with Si—O—Si bridges, that means formed by a condensation reaction. According to column 3, line 53, the polysiloxane has a Shore A hardness of 90. This polysiloxane has about the same hardness as "Viton A" used as comparison binder by the inventors (see table I below). This patent also does not disclose a pressed explosive charge, but a plastic explosive. A plastic explosive is formed by simply mixing the binder and the explosive with each other to an homogeneous mass. In contrast to that a pressed charge is formed by mixing the binder, the explosive and a solvent, and after mixing removing the solvent to form a granulate, and pressing the granulate to the charge with a high pressure of about 2000 to 3000 bars. Teachings of U.S. Pat. No. 2,999,744 relating to the inert portion (binder etc.) may have little or no value in the pressed charge field.

U.S. Pat. No. 4,088,518 discloses a thermosetting cross-linked silicone binder (column 2, lines 28, 29). This cross-linking is attained by a condensation reaction, that is by forming $H_2O$-molecules, so that 2 silicone atoms are bridged by an oxygen atom in the silicone. U.S. Pat. No. 4,088,518 (Kehren) uses a similar polysiloxane as U.S. Pat. No. 2,999,744 (Eckles). That is, according to column 3, line 34 to column 4, line 60 of Kehren the polysiloxanes are formed by a condensation reaction as follows:

$$-Si-OH + HO-Si- \xrightarrow{-H_2O} -Si-O-Si-$$

Consequently, Kehren also obtains charges having a high mechanical strength, as a high modulus of elasticity and a high compressive strength. This is expressively stated in column 2, line 8 ("exceptional mechanical strength"). Furthermore, according to the examples the crushing strength of Kehren's explosive is in the range of about 60 to 350 bars, that is 3 to 35 N/mm$^2$, so that Kehren's charge has about the same strength as the comparison charges according to Table II below.

The prior art explosive charges which meet high safety standards tend to have high binder content and lower explosive content with lower performance. Those explosive compositions with high explosive content do not meet the high safety standards which are desired.

SUMMARY AND OBJECTS OF THE INVENTION

It is an object of the present invention to provide a pressed, plastic-bonded explosive charge which meets all the safety requirements, without any reduction of performance.

This is achieved according to the present invention by using a plastic binder which has a Shore A hardness below 20 and preferably below 10 and especially preferably below 5 at room temperature in the cured, i.e., stable final state.

For example, "VITON A" has a Shore A hardness of 70, and even the softest plastic binders used so far for plastic-bonded pressed charges still have a Shore A hardness exceeding 40. This also applies to other inert binders as plastics, i.e., for example, to wax binders, which also have a considerable hardness at room temperature.

Consequently, the plastic binder used according to the present invention is extremely soft, and preferably soft enough to form a gel. The gel has a penetration greater than 5 mm/10, and preferably greater than 100 mm/10, and especially preferably greater than 200 mm/10 according to DIN ISO 2137 (with a 150-g hollow cone).

The explosive charge according to the present invention or the explosive/plastic binder granular product used to produce it contains more than 90 wt. %, preferably at least 94 wt. %, and especially preferably at least 96 wt. % explosive, i.e., the percentage of plastic binder is less than 10 wt. %, preferably at most 6 wt. %, and especially preferably at most 4 wt. %.

Consequently, all high explosives, e.g., Hexogen Nitropenta, NTO (3 -nitro-1,2,4-triazol-5-one), hexanitrostilbene, or triaminotrinitrobenzene, can be used as explosives according to the present invention, besides Octogen.

The charge according to the present invention has a modulus of elasticity of preferably less than 300 N/mm$^2$, and especially preferably less than 200 N/mm$^2$, as well as a compressive strength of preferably less than 5 N/mm$^2$.

To achieve the results of the invention without the gel mentioned above, an alternative explosive charge is proposed based on examples wherein the plastic binder in the percentages noted above is formed as a mixture of ethylene-vinyl acetate polymer and a plasticizing agent, the plasticizing agent forming from 40% to 60% by weight of the binder. The plasticizing agent is preferably chosen from the group dialkyl-phthalate, dialkyl-sebacate and dialkyl-adipate, the alkyl being a straight chain or branched butyl to decyl group.

According to the other main variant of the invention, the binder is in the form of a gel-like silicone rubber having a penetration according to DIN ISO 2137 in mm/10 of at least 30. A gel-like silicone rubber preferably used according to the invention is "Wacker SilGel 612" of Wacker Chemie GmbH of Munich. A copy of a specification sheet for the Wacker SilGel 612 is attached as Appendix A.

This gel-like silicone rubber is a 2-component silicone rubber curing at room temperatures. The two components called A and B cross-link with each other by addition-crosslinking. Component A as well as B contain prepolymers, component B additionally contains the catalyst to polymerize the pre-polymer to obtain the gel-binder. Both components A and B of "Wacker SilGel 612" are dimethylopolysiloxanes having functional groups. However, the functional groups of A and B are different, so that the addition-crosslinking occurs. For instance, A may carry vinyl groups as functional groups and B Si—H groups which react with the vinyl groups by addition reaction.

The gel-like silicone rubber is a polysiloxane di-substituted by alkyl and/or aryl groups, in particular dialkylpolysiloxane, preferably dimethylpolysiloxane, furthermore, the polysiloxane is polysiloxane made of two polysiloxane components crosslinking with each other by carrying functional groups reacting by addition reaction with each other, the crosslinking being performed preferably at room temperature.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWING

In the drawings:

The sole drawing shows a sectional view of a firing box.

DETAILED DESCRIPTION OF THE INVENTION

The extraordinarily high softness of the plastic binder used according to the present invention can be reached with a high plasticizer content. The amount of plasticizer in the binder is at least 20 wt. % and preferably at least 40 wt. % relative to the plastic-plasticizer mixture, but the percentage of plasticizer should not exceed 80 wt. % and preferably 60 wt. %.

For example, dicarboxylic acid esters, such as di-2-ethylhexyl adipate (DOA), are suitable as plasticizers. Any polymer, especially a thermoplastic, which can be plasticized by a plasticizer to the extent that it will have a Shore A hardness below 20 or below 10 may be used as the plastic. EVA (ethylene-vinyl acetate polymer), which, mixed with, e.g., 40 to 60 wt. % DOA, has a Shore A hardness below 5, has proved to be particularly suitable.

Together with the plasticizer, the polymer is dissolved in a solvent and mixed with the crystalline explosive. After drawing off the solvent, a pressable granular product consisting of explosive embedded in plastic is left.

Besides a thermoplastic, the plastic of the explosive charge according to the present invention may also be a plastic that can be cured by, e.g., polymerization, polycondensation, or polyaddition, or crosslinking. In this case, the explosive is mixed with a solution of the noncured plastic, e.g. in toluene, after removing the solvent, the plastic is cured.

A silicone rubber, which can be crosslinked by addition at room temperature, has provided to be particularly suitable as a plastic binder this plastic binder is commercially available and forms (in the stable final state) a very soft, gel-like vulcanizate with a penetration of ca. 300 mm/10 (DIN ISO 2137, 150-g hollow cone).

To achieve the results of the invention without the gel mentioned above, an alternative explosive charge is proposed based on examples wherein the plastic binder in the percentages noted above is formed as a mixture of ethylene-vinyl acetate polymer and a plasticizing agent, the plasticizing agent forming from 40% to 60% by weight of the binder. The plasticizing agent is preferably chosen from the group dialkyl-phthalate, dialkyl-sebacate and dialkyl-adipate, the alkyl being a straight chain or branched butyl to decyl group.

According to the other main variant of the invention, the binder is in the form of a gel-like silicone rubber having a penetration according to DIN ISO 2137 in mm/10 of at least 5. A gel-like silicone rubber preferably used according to the invention is "Wacker SilGel 612" of Wacker Chemie GmbH of Munich. A copy of a specification sheet for the Wacker SilGel 1612 is attached as Appendix A.

This gel-like silicone rubber is a 2-component silicone rubber curing at room temperatures. The two components called A and B cross-link with each other by addition-crosslinking. Component A as well as B contain a prepolymer, component B additionally contains the catalyst to polymerize the prepolymer to obtain the gel-binder. Both components A and B of "Wacker SilGel 612" are dimethylopolysiloxanes having functional groups. However, the functional groups of A and B are different, so that the addition-crosslinking occurs. For instance, A may carry vinyl groups as functional groups and B Si—H groups which react with the vinyl groups by addition reaction. Accordingly, the polymerization takes place by the following addition reaction:

$$-\mathrm{Si}-\mathrm{H} + \underset{\text{vinyl}}{\mathrm{CH_2{=}CH}}-\mathrm{Si}- \rightarrow -\mathrm{Si}-\underset{\text{ethyl}}{\mathrm{CH_2-CH_2}}-\mathrm{Si}-$$

Thus, a silicon gel with ethyl group bridges between Si atoms is formed. As noted above, such a silicon gel is too soft to define it by the Shore A scale. Accordingly it is defined by its penetration (see table I).

The gel-like silicone rubber is a polysiloxane di-substituted by alkyl and/or aryl groups, in particular dialkylpolysiloxane, preferably dimethylpolysiloxane, furthermore, the polysiloxane is polysiloxane made of two polysiloxane components crosslinking with each other by carrying functional groups reacting by addition reaction with each other, the crosslinking being performed preferably at room temperature.

The explosive/plastic binder granular product according to the present invention can be pressed by means of a hydraulic press under a pressure of 1000 bar or higher into an explosive charge, whose density preferably exceeds 92% and especially preferably 97% of the theoretical maximum density. Further, an embodiment according to example 1 below is discussed with regard to tests where it is referred to as PBX-31 and has a high density which is 99.4% of the theoretical maximum density (see table IV).

A further important advantage of the granulate of the present invention is that it is pressable at room temperature, so that a heatable press mould is not necessary. The pressure used is about 2,5 to 3 kbar.

The present invention will be explained in greater detail by the following examples.

EXAMPLE 1

200 g each of the aforementioned components A and B of the silicone gel binder and 6 L toluene are charged into a 25-L planetary mixer. After adding 9.6 kg Octogen (particle size 5 to 600 microns), the mixture is homogenized. Most of the toluene is removed from the homogeneous mass at 60°–80° C. under 10–20 mbar. The remaining Octogen/plastic binder granular product is dried at 100° C. within 2 hours. The gel-like silicone rubber is a polysiloxane di-substituted by alkyl and/or aryl groups, in particular dialkylpolysiloxane, preferably dimethylpolysiloxane, furthermore, the polysiloxane is polysiloxane made of two polysiloxane components crosslinking with each other by carrying functional groups reacting by addition reaction with each other, the crosslinking being performed preferably at room temperature.

Preferably, the silicone gel is heated for two hours at 100° C. as noted. However, the silicone gel is not completely cured when dried at 100° C. for two hours. After drying it is cured for about two days at about 120° C., so that about 85 to about 99% of the double bonds, i.e. the vinyl groups of the prepolymer have reacted. The resulting explosive/plastic binder granulate has a practically unlimited shelf time. The resulting granulate shows a good pourability, so that it is easy to dose.

EXAMPLE 2

200 g each of EVA and DOA (the plasticizing agent) are dissolved in 6 L toluene. Together with 9.6 kg Octogen (particle size 5 to 600 microns), the solution is homogenized in a 25-L planetary mixer. Most of the toluene is removed from the homogeneous mass at 60°–80° C. under 10–20 mbar. The remaining Octogen/plastic binder granular product is dried at 80° C. in 12 hours.

Using a hydraulic press, pressed charged A and B were produced from the Octogen/plastic binder mixtures according to the Examples 1 and 2, both of which contain 96 wt. % Octogen.

As an alternative to Example 2 noted immediately above, the ratio of the plastic to plasticizer may be varied between 20 wt. % plasticizer and 80 wt. % plasticizer. The percentage of plasticizer preferably should vary between 40 and 60 wt. %. For example, instead of the 200 g. EVA and 200 g DOA of Example 2, the invention also contemplates the variation of Example 2 wherein 240 g of EVA and 160 g. of DOA are provided and processed as noted in Example 2 (first variant of Example 2). As a further variant, 160 g. of EVA and 240 g. of DOA are processed according to Example 2 (second variant of Example 2). The invention further proposes a variation of the plasticizing agent to achieve the results detailed below. For example, the DOA as a plasticizing agent in Example 2 (and also the first variant of Example 2 and the second variant of Example 2 noted above) may be instead selected from the group: dialkyl-phthalate, dialkyl-sebacate and dialkyl-adipate, the alkyl being a straight chain or branched butyl to decyl group.

For comparison, an Octogen/plastic binder granular product was produced from the same Octogen of the same particle size as in Examples 1 and 2 and with the same percentage of Octogen of 96 wt. %, but "Viton A" (hexafluoropropylene-vinylidene fluoride (1:2) polymer) or pure EVA (i.e., without plasticizer) was used as the plastic binder. Pressed charges C ("Viton A") and D (EVA) were produced from these materials under the same conditions as in the case of the granular products according to Examples 1 and 2.

The properties of the plastic binders used for the charges A through D are shown in Table I below, and the strength characteristics of the charges A through D pressed with these plastic binders are shown in Table II.

TABLE I

| Plastic binder | Hardness (Shore A) | Penetration (mm/10) |
|---|---|---|
| Charge A Silicon gel vulcanizate (Example 1) | — | 300 |
| Charge B EVA/DOA (Example 2) | 2 to 3 | — |
| Charge C "Viton A" (Comparison) | 70 | — |
| Charge D EVA (Comparison) | 35 | — |

TABLE II

| | Modules of elasticity ($N/mm^2$) | Compressive strength ($N/mm^2$) |
|---|---|---|
| Charge A present invention | 150 | 2 |
| Charge B | 130 | 2.5 |
| Charge C Comparison | 550 | 10 |
| Charge D | 380 | 8 |

One charge A through D each was introduced into a firing box, whose cross section is shown in the drawing and consists of a cylindrical steel shell 1 with an internal diameter of 50 mm and has a wall thickness of 5 mm, onto which steel closing cap 2 and 3 with an internal thread 4 and 5 are screwed on both sides.

The firing boxes containing the charge A through D were then fired on with 12.7-mm hard core ammunition in the direction of arrow 6 according to the STANAG Specifications No. 4241 "Bullet Attack Test For Munitions" of May 9, 1988.

Furthermore, the pressed charges A through D were subjected to the so-called "Fast Cook-Off" test according to STANAG Specification No. 4240 of "Liquid Fuel Fire Tests for Munitions" of May 9, 1988. To do so, the charges A through D were tamped into firing boxes according to the drawing and heated at a rate of approximately 3K/sec until the explosive charge reacted. The violence of the reaction and consequently the sensitivity of the explosive charge are inferred from the appearance of the charges A through D or of the shell 1 after the event, i.e., after the bullet impact or the reaction of the explosive charge.

Based on the appearance of shell 1 or the explosive charge, the following types of reaction are distinguished:

RT 0=shell fully intact, only bullet hole in the explosive charge,

RT 1=shell fully intact, cracks in the explosive charge,

RT 2=shell fully intact, explosive charge burned out,

RT 3=shell bulged but not burst,

RT 4=shell burst into two or more large parts,

RT 5=shell broken into many small slivers.

The results obtained with the charges A through D in the bullet attack test and the "Fast Cook-Off" test are shown in Table III below.

TABLE III

| | Bullet fire (type of reaction) | Cook-Off (type of reaction) |
|---|---|---|
| Charge A Present invention | 0 | 2 |
| Charge B | 1 | 2 |
| Charge C Comparison | 5 | 5 |
| Charge D | 5 | 5 |

As is apparent from Table III, the charges A and B according to the present invention are practically fully insensitive to bullet impact (RT 0 and RT 1, respectively), and only burning out of the charges takes place in the "Fast Cook-Off" test as well, while the shell remains fully intact (RT 2). In contrast, the reference charges C and D burst into small slivers (RT 5) in both the bullet attack test and the "Fast Cook-Off" test.

Besides the bullet attack with hard core ammunition, the charges A and B were also fired on in the firing box according to the present invention with a small hollow charge (caliber 25 mm), from a distance corresponding to 3 times the caliber. Only the reaction types 0 through 1 were observed.

To check the performance capacity of the charge according to the present invention, explosions were carried out with standard hollow charges with a caliber of 96 mm, which were produced from the Octogen/plastic binder granular product according to Example 1. The depth of penetration of the hollow charge spike of this hollow charge into a steel block was evaluated as the performance criterion. At a distance of 768 mm between the hollow charge and the steel block, depths of penetration of between 900 and 1000 mm into the steel block were measured. This corresponds to the results obtained with pressed hollow charges which were produced from the commercially available Octogen/plastic binder granular products PBX N5 (with "Viton A" as the plastic binder) and LX 14 (with "Estane" as the plastic binder), or with a cast hollow charge made from Octol (Octogen/TNT 85/15). Consequently, despite its low sensitivity, the explosive charge according to the present invention has a performance level comparable to that of the prior-art high-performance explosive charges.

Still another charge was prepared according to example 1. This further charge according to example 1 is referred to as PBXP-31 and as specified in example 1 is formed with 96 weight percent explosive (HMX) and 4 weight percent silicone—see table IV. Tests were done on this explosive PBXP-31 by the Navel Sea Systems Command (NAVSEA) Intensive Munitions Advance Developments (IMAD) program, High Explosives (HE) project. This relates to the middle accelerating task which is a program designed to develop and test high performance explosive formulations for fragmenting warheads, shaped-charge designs, and submunitions. Formulations that demonstrate improvements and safety, vulnerability and performance are qualified under this task for future navy use.

Several explosives of interest for shape-charge applications were tested which typically were highly-filled, HMX-based, pressed and casted compositions. The pressed compositions were LX-14(N), PAX-2, PAX-2A, PBXW-9 TYPE II(Q), PBXW-11 and PBXP-31. The cast compositions were ERDCO-301, OCTOL 85/15, PBXC-129(Q) and PBXN-110. For each of the compositions tested, the compositions are noted in table IV and the explosive properties are found in table V. A complete discussion of this testing is presented in the paper entitle *High Performance Metal-Accelerating Explosives for Insensitive Munitions Applications* by S. L. Collignon, W. P. Burgess, W. H. Wilson and K. D. Gibson of the Navel Surface Warfare Center Explosive Dynamics Branch, Code R15 Dahlgren, Va. 2248-5000, the contents of which are here by incorporated by reference. In these tests, LX-14(N) and OCTOL 85/15 served as based line explosives for the pressed and cast explosive categories respectively. The base line explosives were subjected to the same test conditions as the candidate explosives.

The explosive compositions were tested and evaluated according to

MIL-STD-2105A procedures for fast cook off (FCO) slow cook off (SCO), and bullet impact (BI) tests. In addition to these standard test, two tests were developed to further evaluate the explosive candidates. These were: (1) the single fragment impact test (SFI) and (2) the variable confinement cook off test (VCCT). The SFI test was designed to evaluate the shock sensitivity of the candidate materials using a 0.564-inch diameter steel cylinder instead of the standard 0.5-inch steel cube. The cylinder provided the same cross-sectional impact area as the 0.5-inch cube yet was more aerodynamic in flight, allowing a high degree of confidence in obtaining a flat impact. The impact velocity of the cylinder was varied to establish the threshold velocity to detonation velocity for each candidate explosive. The VCCT use small explosive samples to evaluate the SCO behavior of the candidate formulations when highly defined.

FAST COOKOFF

The fast cook off tests were conducted as outlined in the above-referenced paper wherein the test units were sub-

TABLE IV

Candidate Shaped-Charge Explosives

| Formulation | Binder | Weight Percent | Explosive | Weight Percent | Developer |
|---|---|---|---|---|---|
| LX-14(N) | Estane | 4.5 | HMX | 95.5 | LLNL[1] |
| PAX-2 | NP/CAB[x] | 12/8 | HMX | 80 | ARDEC[2] |
| PAX-2A | NP/CAB[x] | 9/6 | HMX | 85 | ARDEC |
| PBXW-9 TYPE II(Q) | DOA/Hycar | 6/2 | HMX | 92 | NSWCDD |
| PBXW-11 | Hycar | 3/1 | HMX | 96 | NSWCDD |
| PBXP-31 | Silicone | 4 | HMX | 96 | MBB[3] |
| ERDCO-301 | TNT/Urthn. | 15/3 | HMX | 82 | ERDCO[4] |
| OCTOL 85/15 | TNT | 15 | HMX | 85 | MBB |
| PBXC-129(Q) | LM | 11 | HMX | 89 | NAWCWD[5] |
| PBXN-110 | HTPB | 12 | HMX | 88 | NSWCDD |

[1]Lawrence Livermore National Laboratory
[2]Army Research and Development Engineering Command
[3]Messerschmitt Boelkow Blohm
[4]Explosive Research and Development Company
[5]Naval Air Warfare Center Weapons Division, China Lake, California
[x]CAB = Cellulose Acetate Butyrate

TABLE V

Candidate Shaped-Charge Explosive Characteristics

| Explosive | Density (g/cc) TMD* | Density (g/cc) Nominal | Detonation Pressure (kbar) | Detonation Velocity (mm/μsec) | Gurney Constant (5 mm/19 mm) |
|---|---|---|---|---|---|
| LX-14(N) | 1.85 | 1.82 | 351[xx] | 8.83 | 2.30/2.95 |
| PAX-2 | 1.74 | 1.73 | 300[xx] | 8.35 | —/2.85 |
| PAX-2A | 1.79 | 1.78 | NA | 8.52 | NA |
| PBXW-9 TYPE II(Q) | 1.76 | 1.73 | 296 | 8.49 | 2.58/2.90 |
| PBXW-11 | 1.83 | 1.80 | 342[xx] | TBD | TBD |
| PBXP-31 | 1.83 | 1.82 | 330[xx] | 8.56 | NA |
| ERDCO-301 | 1.84 | 1.80 | 345[xx] | 8.51 | NA |
| OCTOL 85/15 | 1.86 | 1.86 | 366 | 8.74 | 2.57/2.89 |
| PBXC-129(Q) | 1.72 | 1.72 | 307[xx] | 8.37 | TBD |
| PBXN-110 | 1.68 | 1.68 | 291 | 8.39 | 2.44/2.70 |

*Theoretical Maximum Density
[xx]Calculated jected to an enveloping flame produced by burning JP-5 fuel until the fire subsided (minimum temperature 1600° F.). Table VI provides a summary of the test results.

TABLE VI

Fast Cookoff Test Results

| Formulation | S/N | Reaction |
|---|---|---|
| LX-14(N) | 319 | Burn |
| | 320 | Burn |
| PAX-2 | 251 | Burn |
| | 257 | Burn |
| PBXW-9 TYPE 11(Q) | 311 | Burn |
| | 312 | Burn |
| PBXW-11 | 4 | Burn |
| | 11 | Burn |
| PBXP-31 | 222 | Burn |
| | 230 | Burn |
| ERDCO-301 | 278 | Partial Detonation |
| | 279 | Burn |
| OCTOL 85/15 | 201 | Burn |
| | 203 | Partial Detonation |
| PBXN-110 | 51 | Burn |
| | 56 | Burn |

The test results show that OCTOL 85/15 and ERDCO-301 both reacted violently (partial detonation) when exposed to an enveloping fuel fire. This characteristic is typical of melt-cast, TNT-filled explosives. The remainder of the explosives including example 1 described above (PBXP-31) tested passed the FCO test.

SLOW COOKOFF

Units charged with the explosive were subjected to slow heating wherein oven temperatures and warhead temperatures were measured by placing thermal couples in the oven and on the warhead case. The heating was at 6° F./hr. The temperature at which a reaction occurred is found in table VII.

TABLE VII

Slow Cookoff Test Results

| Formulation | S/N | Temperature (°C.) | Reaction |
|---|---|---|---|
| LX-14(N) | 317 | 174 | Detonation |
| | 318 | 170 | Detonation |
| PAX-2 | 263 | 163 | Explosion |
| | 270 | 165 | Explosion |
| PBXW-9 TYPE II(Q) | 315 | 180 | Burn |
| | 316 | 182 | Burn |
| PBXW-11 | 2 | 176 | Burn |
| | 27 | 179 | Burn |
| PBXP-31 | 218 | 183 | Partial Detonation |
| | 247 | 175 | Partial Detonation |
| ERDCO-301 | 281 | 178 | Detonation |
| | 289 | 175 | Detonation |
| OCTOL 85/15 | 206 | 192 | Detonation |
| | 212 | 190 | Detonation |
| PBXN-110 | 57 | 166 | Burn |
| | 118 | 166 | Burn |

The data show that PBXN-110, PBXW-9 TYPE II(Q) and PBXW-11 meet the burn reaction criteria of MIL-STD-2105A. In these tests, no damage was incurred by the test unit case. During the test, the shaped-charge liner was collapsed and expelled, allowing the explosive to burn mildly. With the exception of ERDCO-301, all of the explosives including example 1 described above (PBXP-31) tested demonstrated milder reactions to SCO conditions than either baseline explosive.

BULLET IMPACT

Bullet Impact tests included 350 caliber AP bullets fired at 2800 FT/S with 50 +or − 10 MS between impacts. The bullet velocity was measured using electronic velocity screens placed between the guns and the containers housing the explosive. Table VIII presents a summary of the test results.

TABLE VIII

Bullet Impact Test Results

| Explosive | S/N | Reaction |
|---|---|---|
| LX-14(N) | 321 | Deflagration |
| | 322 | Deflagration |
| PAX-2 | 267 | Burn |
| | 269 | Deflagration |
| PBXW-9 TYPE II | 20 | Burn |
| | 36 | Burn |
| PBXP-11 | 23 | Deflagration |
| | 32 | Deflagration |
| PBXP-31 | 226 | Deflagration |
| | 245 | Deflagration |
| ERDCO-301d | 280 | Burn |
| | 287 | Burn |
| OCTOL 85/15 | 214 | Deflagration |
| | 215 | Detonation |
| PBXN-110 | 116 | Burn |
| | 117 | Burn |

The most violent reaction during the BI test was observed while testing OCTOL 85/15. Upon detonation of the explosive, a shaped-charge jet was partially formed and left a shallow hole in the witness plate. LX-14(N), PBXW-11 and PBXP-31 failed BI testing with deflagration reactions. Varied results were obtained during duplicate testing of PAX-2, ranging from a burning reaction to a deflagration reaction. Within the classification of burning and deflagration reactions, PAX-2 demonstrated the mildest burning and mildest deflagration reaction of the candidates tested. A significant amount of explosive was left in the warhead following the test classified as a burning reaction. For the deflagration reaction of PAX-2, only half of the warhead case was thrown from the fixture (90 feet) and no pressure pulse was recorded. In typical deflagration reactions, the cases are split into two pieces and both are thrown from the holding fixture. Moreover, pressure pulses are typically recorded. However, reactions that either threw portions of the case from the holding fixture or produced enough blast to record a pressure pulse were classified as deflagration reactions.

SINGLE-FRAGMENT IMPACT TEST

All of the explosive compositions being considered were of a high HMX content, and it was predicted that they would detonate at the required fragment velocity. The single fragment impact test was developed to accurately assess the fragment impact sensitivity of the candidate explosives using flat-nosed cylindrical projectiles. The goal is for the projectiles to strike the explosive-filled targets at 0° impact angle. This provided a consistent means by which to evaluate the explosive candidates, with a flat impact being the most severe case. The projectile was a 0.564-inch diameter steel cylinder fired from a gas gun for higher velocities wherein velocities less than 4,000 ft/s were provided by a rifled powder gun. The projectile weights were 65 grams and 27.5 grams respectively. As demonstrated in a study by Slade and Dewey, mass or kinetic energy has no effect on the impact sensitivity of explosives; their study noted a dependence on impact velocity and area. The critical velocity of single-fragment required to detonate in each candidate explosive is as follows: LS-14(N) (2723 ft/s); PAX-2 (3095 ft/s); PBXW-9 TYPE II(Q) (3081 ft/s); PBXW-11 (2862 ft/s); PBXP-31 (3397 ft/s); OCTOL 85/15 (3495 ft/s); PBXC-129(Q) (4107 ft/s); PBXN-110 (4553 ft/s). Table IX summarizes the highest no-detonation and lowest detonation velocity data for each explosive.

TABLE IX

Highest Detonation Velocity and Lowest No-Detonation Velocity For Candidate Explosives

| Formulation | Highest No-Go* | Lowest Go** | Critical Velocity ($V_c$) (ft/s) |
|---|---|---|---|
| LX-14(N) | 2665 | 2778 | 2723 ± 57 |
| PAX-2 | 3028 | 3162 | 3095 ± 67 |
| PBXW-9 TYPE II(Q) | 3058 | 3104 | 3081 ± 23 |
| PBXW-11 | 2827 | 2897 | 2862 ± 35 |
| PBXP-31 | 3176 | 3617 | 3397 ± 220 |
| OCTOL 85/15 | 3445 | 3547 | 3495 ± 51 |
| PBXC-129(Q) | 4056 | 4157 | 4107 ± 51 |
| PBXN-110 | 4455 | 4650 | 4552 ± 98 |

*Highest fragment impact velocity that did not cause the explosive to detonate
**Lowest fragment impact velocity that caused the explosive to detonate.

These data show that PBXN-110 AND PBXC-129(Q) are the least vulnerable (i.e., require the highest velocity to detonate) of the candidate explosives to the impact of the 0.564-inch diameter cylinder. Note that both of these candidates are cast-cured. The next least sensitive explosive was OCTOL 85/15, an energetic melt-cast composition. Cast compositions are less shock sensitive in general than pressed compositions, because the cast compositions have less HMX by comparison and are virtually void-free, i.e., have densities close to 100 percent of theoretical maximum density (TMD). The least sensitive pressed explosive tested was PBXP-31, which was pressed in excess of 99 percent of TMD. (With the exception of PAX-2, all other explosives were passed to approximately 98–98.5 percent of TMD). The order of impact sensitivity, with PBXN-110 being the least sensitive to fragment impact, was: PBXN-110<PBXC-129(Q)<PBXP-31<PAX-2<PBXW-9 <PBXW-11<LX-14(N). In all cases, the candidate explosives demonstrated improved vulnerability to fragment impact as compared to the baseline explosive.

VARIABLE CONFINEMENT COOKOFF TEST

This test as outlined in the above reference paper was conducted by heating a sample at a specified rate of 3.3° C. per hour until a reaction occurred. Duplicate testing was conducted for each sample at each confinement wherein the confinement was increased in increments of 0.015-inch until a reaction more violent then a burn was note. The confinement pressure at which explosive translated to a reaction level greater than a burn is as follows: LX-14(N) (1200 psi); PAX-2 (7725 psi); PBXW-9 TYPE II(Q) (15300 psi); PBXW-11 (7725 psi); PBXP-31 (10000 psi); PBXC-129(Q) (15300 psi).

COMPARISON OF VARIABLE CONFINEMENT COOKOFF

TEST AND SLOW COOKOFF TEST RESULTS

A comparison of the VCCT pressures required to induce a violent reaction and the responses of each explosive during SCO testing in the 3.2-inch GSCTU show that a direct correlation cannot be made. However, the data show that if an explosive passes the VCCT at a steel confinement of 0.030 inches, it has the potential of passing SCO testing in the 3.2-inch GSCTU. For example, PBXW-11 passed at 0.030-inch confinement and failed at 0.045-inch confinement. PAX-2 was the mildest failing reaction of the candidates tested in the 3.2-inch GSCTU. The one explosive that contradicted the general trend was PBXP-31, which passed the VCCT at 0.045-inch confinement, but partially detonated during SCO testing in the 3.2-inch GSCTU.

ARMOR PENETRATION

Explosive performance was determined through the measurement of shaped-charged jet penetration into a stack of rolled homogenous armor plates as detailed in the above-referenced paper. The average penetration depth of each explosive is summarized in table X. The test relates to warheads statically tested at standoffs at 2, 5, 7 and 9 charge diameters (CD=3.2-inches). The data show that at standoffs of 2, 5 and 7 CDs PBXP-31 provided armor penetration that exceeded the performance of all other candidates including OCTOL 85/15 and LX-14.

The above results show that the invention of example 1 referred to as PBXP-31 passed the first cookoff test. In the slow cookoff test (SCO) the invention of example 1 (PBXP-31) demonstrated milder reactions than the base line explosives. In the Bullet Impact test PBXP-31 showed deflagration, i.e. also a moderate reaction. According to the paper providing the details of the testing, the invention of example 1 (PBXP-31) was the least sensitive explosive tested. The tests also noted that the invention of example 1 (PBXP-31) passed a variable confinement cookoff test. The composition of example 1 (PBXP-31) passed the safety test and was evaluated as the "least sensitive pressed explosive tested". This is an exceptional result in view of the results in the "armor penetration" test detailed in the same paper. PBXP-31 (the composition of example 1) showed by far the best performance, that is the data show that PBXP-31 provided armor penetration that exceeded the performance of all the candidates.

While a specific embodiment of the invention has been shown and described in detail to illustrate the application of the principles of the invention, it will be understood that the invention may be embodied otherwise without departing form such principles.

What is claimed is:

1. An explosive charge, comprising: a pressed plastic bonded explosive charge having an explosive charge content of at least 94% by weight, said pressed explosive charge being formed of one of octogene or hexogene and 6% or less by weight of a binder, said pressed explosive charge having a density which is at least 97% of a theoretical maximum density, said binder being a gel-like silicone rubber which is a polysiloxane di-substituted by alkyl and/or aryl groups formed of two polysiloxane components crosslinking with each other by carrying functional groups reacting by addition reaction with each other, said gel-like silicone rubber having penetration according to DIN ISO 2137 in mm/10 of at least 30.

2. An explosive charge according to claim 1, wherein said crosslinking is performed at a temperature between room temperature and 130° C.

3. An explosive charge according to claim 1, wherein said explosive charge content is at least 96% by weight and said binder is 4% by weight or less.

4. An explosive charge according to claim 1, wherein said pressed charge is pressed under a pressure of 1000 bar or higher.

5. Explosive charge according to claim 1, wherein said charge has a modulus of elasticity of less than 300 $N/mm^2$.

6. An explosive charge according to claim 1, wherein said charge has a compressive strength less than 5 $N/mm^2$.

7. An explosive charge, comprising: an explosive granular product formed of at least 96% by weight of one of octogene or hexogene and 4% or less by weight of a binder, said binder being a gel-like silicon rubber which is a polysiloxane di-substituted by alkyl and/or aryl groups formed of two polysiloxane components crosslinking with each other by carrying functional groups reacting by addition reaction with each other to provide an ethyl group ($—CH_2—CH_2—$) bridge between Si atoms, said gel-like silicone rubber having a penetration according to DIN ISO 2137 in mm/10 of at least 30, said explosive granular product being pressed to form a charge having a density which is at least 97% of a theoretical maximum density.

8. An explosive charge according to claim 7, wherein said explosive granular product is pressed under a pressure of 1000 bar or higher.

9. Explosive charge according to claim 7, wherein said charge has a modulus of elasticity of less than 300 $N/mm^2$.

10. An explosive charge according to claim 7, wherein said charge has a compressive strength less than 5 $N/mm^2$.

11. An explosive charge according to claim 7, wherein said cross linking is performed at a temperature between room temperature and 130° C.

12. A pressable explosive granular product comprising: at least 96% by weight of one of octogene or hexogene and 4% or less by weight of a binder, said binder being a gel-like silicon rubber having a penetration according to DIN ISO 2137 in mm/10 of at least 30.

13. A pressable explosive granular product according to claim 12, wherein said binder is a gel-like silicone rubber polysiloxane di-substituted by alkyl and/or aryl groups and said polysiloxane is formed of two polysiloxane components cross linking with each other by carrying functional groups reacting by addition reaction with each other.

14. A pressable explosive granular product according to claim 13, wherein said cross linking is performed at a temperature between room temperature and 130° C.

15. An explosive charge, comprising: a pressed plastic bonded explosive charge having an explosive charge content of at least 94% by weight, said pressed explosive charge being formed of one of octogene or hexogene and 6% or less by weight of a binder, said pressed explosive charge having a density which is at least 97% of a theoretical maximum density, said binder being a gel-like silicone rubber with ethyl group ($—CH_2—CH_2—$) bridges between Si atoms, said gel-like silicone having penetration according to DIN ISO 2137 in mm/10 of at least 30.

16. An explosive charge according to claim 15, wherein said crosslinking is performed at a temperature between room temperature and 130° C.

17. An explosive charge according to claim 15, wherein said explosive charge content is at least 96% by weight and said binder is 4% by weight or less.

18. An explosive charge according to claim 15, wherein said pressed charge is pressed under a pressure of 1000 bar or higher.

19. An explosive charge according to claim 15, wherein said charge has a modulus of elasticity of less than 300 $N/mm^2$ and a compressive strength less than 5 $N/mm^2$.

20. An explosive charge according to claim 12, wherein said gel-like silicone rubber is a polysiloxane di-substituted by alkyl and/or aryl groups.

21. An explosive charge according to claim 2, wherein said polysiloxane is dialkylpolysiloxane.

22. An explosive charge according to claim 1, wherein said crosslinking is performed at a temperature of 100° C. to 130° C.

23. An explosive charge according to claim 7, wherein said crosslinking is performed at a temperature of 100° C. to 130° C.

24. An explosive charge according to claim 12, wherein said crosslinking is performed at a temperature of 100° C. to 130° C.

25. An explosive charge according to claim 15, wherein said crosslinking is performed at a temperature of 100° C. to 130° C.

* * * * *